US005682631A

United States Patent [19]

Weismiller et al.

[11] Patent Number: 5,682,631

[45] Date of Patent: Nov. 4, 1997

[54] BED HAVING A REDUCED-SHEAR PIVOT AND STEP DECK COMBINATION

[75] Inventors: Matthew W. Weismiller; Peter M. Wukusick; Gregory W. Branson, all of Batesville; Kenneth L. Kramer, St. Paul, all of Ind.; Philip D. Palermo, Celina, Ohio; David J. Ulrich, Sunman, Ind.; David A. Albersmeyer, Batesville, Ind.; Jason C. Brooke; Eric R. Meyer, both of Greensburg, Ind.; John D. Miller, Brookville, Ind.

[73] Assignee: Hill-Rom, Inc., Batesville, Ind.

[21] Appl. No.: 511,512

[22] Filed: Aug. 4, 1995

[51] Int. Cl.[6] ..... A61G 7/015

[52] U.S. Cl. ..... 5/618; 5/706; 5/722

[58] Field of Search ..... 5/600, 613, 614, 5/616, 618, 617, 722, 706

[56] References Cited

U.S. PATENT DOCUMENTS

| | | | |
|---|---|---|---|
| 1,398,203 | 11/1921 | Schmidt . | |
| 2,913,300 | 11/1959 | Darnell et al. . | |
| 3,281,141 | 10/1966 | Smiley et al. . | |
| 3,406,772 | 10/1968 | Ahrent et al. . | |
| 3,593,350 | 7/1971 | Knight et al. . | |
| 3,821,821 | 7/1974 | Burst et al. . | |
| 4,097,940 | 7/1978 | Tekulve et al. . | |
| 4,127,906 | 12/1978 | Zur . | |
| 4,139,917 | 2/1979 | Fenwick . | |
| 4,183,109 | 1/1980 | Howell . | |
| 4,312,500 | 1/1982 | Janssen . | |
| 4,369,535 | 1/1983 | Ekkerink | 5/237 |
| 4,409,695 | 10/1983 | Johnston et al. . | |
| 4,411,035 | 10/1983 | Fenwick . | |
| 4,559,655 | 12/1985 | Peck . | |
| 4,559,656 | 12/1985 | Foster . | |
| 4,592,104 | 6/1986 | Foster et al. . | |
| 4,751,754 | 6/1988 | Bailey et al. . | |
| 4,862,529 | 9/1989 | Peck . | |
| 4,894,876 | 1/1990 | Fenwick . | |
| 4,944,055 | 7/1990 | Shainfeld . | |
| 5,072,463 | 12/1991 | Willis . | |
| 5,144,707 | 9/1992 | Callaway et al. . | |
| 5,245,716 | 9/1993 | Callaway et al. . | |
| 5,279,010 | 1/1994 | Ferrand et al. . | |
| 5,398,357 | 3/1995 | Foster . | |
| 5,454,126 | 10/1995 | Foster et al. . | |

*Primary Examiner*—Alexander Grosz
*Attorney, Agent, or Firm*—Barnes & Thornburg

[57] ABSTRACT

A bed is provided having a head end, a foot end, and sides. The bed includes a frame and a deck carried by the frame. The deck includes an upper deck portion and a central, longitudinal recess in the upper deck portion. The recess is defined by a lower deck portion and walls connecting the lower and the upper deck portions. The bed also includes a mattress including a planar, upwardly-facing patient surface, side portions resting on the side deck portions, and a central projection extending downwardly into the recess. A first longitudinal deck section is coupled to the deck to pivot about a pivot axis above the lower deck portion between a generally horizontal position and a tilted position.

17 Claims, 9 Drawing Sheets

BED HAVING A REDUCED-SHEAR PIVOT AND STEP DECK COMBINATION

BACKGROUND AND SUMMARY OF THE INVENTION

The present invention relates to a bed, and particularly to a deck for supporting a mattress on a bed or other patient-supporting device in combination with a reduced-shear pivot assembly for connecting articulating portions of the deck to stationary portions of the deck. More particularly, the present invention relates to a deck and a pivot assembly for a hospital bed or a patient-care bed which is convertible to a chair and the usual reclining positions between the normal horizontal bed position and the chair position. The bed of the present invention is ideal for supporting patients who are likely candidates for skin problems, notably decribitis ulcers.

The deck or "step deck" as it is referred to herein has a central, longitudinally extending deck portion and raised or elevated longitudinally extending upper deck portions along the sides. The step deck is movable so that the bed is convertible between a conventional bed position having a horizontal sleeping surface and a sitting position having the head and back of the person supported in an upright position. The bed may be stopped. The mechanism for moving the deck to the sitting position includes a "reduced-shear" pivot that cooperates with the step deck to minimize the shear forces between the person and the sleeping surface when the bed moves between the bed position and the sitting position.

Beds and examination tables having articulating decks to adjust the position of the person on the support surfaces thereof are known in the art. See, for example, U.S. Pat. No. 5,077,843 to Foster L. Dale et al., U.S. Pat. No. 5,157,800 to Borders, U.S. Pat. No. 5,129,177 to Celestina et al., U.S. Pat. No. 4,862,529 to Peck, and U.S. Pat. No. 4,751,754 to Baily et al., all of which are assigned to the assignee of the present invention, and U.S. Pat. No. 3,281,141 to Smiley et al., U.S. Pat. No. 5,279,010 to Ferrand et al., U.S. Pat. No. 4,183,109 to Howell, U. S. Pat. No. 4,411,035 to Fenwick, and U.S. Pat. No. 3,220,022 to Nelson, as well as German publication No. 716981. Each of these references discloses a bed r an examination table having a top surface that articulates to adjust the position of the person on the surface. See also U.S. patent application Ser. No. 08/511,711, filed Aug. 4, 1995 and titled Chair Bed, the specification of which is herein incorporated by reference.

According to the present invention, a chair bed for a person is provided, the chair bed having a head, a foot, and sides, and including a unique combination of a step deck with a reduced-shear pivot feature. The bed includes a frame and a deck carried by the frame. The deck includes an upper deck portion and a central, longitudinal recess in the upper deck portion, the recess being defined by a lower deck portion and walls connecting the upper and lower deck portions. In addition, the bed includes a mattress having a planar, upwardly-facing support surface, side portions resting on the side deck portions, and a central projection extending downwardly into the recess. The bed also includes a first longitudinal deck section coupled to the deck to pivot about a pivot axis above the lower deck portion between a generally horizontal position and a tilted position.

In preferred embodiments, the chair bed includes a base frame, an intermediate frame coupled to the base frame, a weigh frame coupled to the intermediate frame, and an articulating deck coupled to the weigh frame. The articulating deck has longitudinally spaced head, seat, thigh, and foot sections. The head, thigh, and foot sections are movable relative to each other and are movable relative to the seat section which is fixed relative to the weigh frame. The head, thigh, and foot sections are infinitely adjustable to allow the chair bed to attain any desired position within the range of movement of the head, thigh, and foot sections, thus accommodating changes of position of a person on the chair bed. The illustrative articulating deck can provide a planar, horizontal sleeping surface, a planar sleeping surface that is tilted toward either the head end of the chair bed or the foot end of the chair bed, and a non-planar chair-shaped seating surface, in addition to the intermediate positions therebetween.

The chair bed can include a mechanism for raising and lowering the articulating deck and the sleeping surface between a low position and a raised position relative to the base of the chair bed. In addition, the chair bed can also include mechanisms for independently raising and lowering each of the head section, the thigh section, and the foot section so that the chair bed can assume many positions to suit the specific needs of individual people.

A companion mattress is carried by the deck. The mattress has a planar, upwardly-facing sleeping surface, side portions resting on the side deck portions, and a projection beneath the sleeping surface. The projection extends downwardly into the recess and can engage at least a portion of the side wall of the deck. The varied thickness of the mattress provides the mattress with "zones" including a thick zone adjacent to the projection and a thin zone in areas away from the projection. The mattress includes a head mattress portion, a seat mattress portion, a thigh mattress portion, and a foot mattress portion. Each named mattress portion is associated respectively with the head, seat, thighs, and feet of the person resting on the sleeping surface of the bed as well as with the underlying head, seat, thigh, and foot sections of the deck.

Though there are many potential variations of step deck shapes and corresponding mattress shapes and numbers and types of mattress pieces that could be devised, any step deck having an upper deck portion and a recess defined by a bottom deck portion and walls connecting the bottom and the upper deck portions would achieve the desired results. Likewise, any mattress or combination of mattress pieces that provide a bottom surface generally conforming to the shape of the step deck would achieve the desired results.

The movable head section is coupled to the weigh frame and is configured to pivot relative to the weigh frame about an effective pivot axis positioned to lie above the sleeping surface. Preferably, the effective pivot axis is located generally adjacent to a pivot axis defined by the hip of a person lying on the sleeping surface in order to minimize the shear between the sleeping surface and the back of the person in the bed as the head section moves between the down position and the back-support position. To achieve this "reduced-shear" pivot, the head section is mounted to the weigh frame for both translational movement and pivoting movement relative to the weigh frame. The pivoting and translational movements combine to produce a motion in which the head portion pivots relative to the frame about the effective pivot axis.

The head section of the articulating deck can pivot relative to the weigh frame between a down position generally parallel to the weigh frame and an upward back-support position. When a person on a sleeping surface moves from a flat position to a sitting position, the back and legs of the person engaging the sleeping surface lengthen.

The reduced-shear pivot accommodates this lengthening to reduce the shear between the back and legs of the person and the sleeping surface as the head section pivots between the down position and the back-support position by expanding the deck and the sleeping surface. The reduced-shear pivot allows the upper body of the person on the sleeping surface to be tilted upwardly without moving the lower body of the person. This reduces the tendency of the person to slide relative to the sleeping surface during articulation of the head section, thereby reducing the shear between the back and legs of the person and the sleeping surface.

The head section is coupled to the walls adjacent to the seat section and above the lower deck so that the head section is movable from a generally horizontal down position to a back-support position providing a pivotable backrest. Preferably, the head section simultaneously translates toward the head end of the bed and pivots upwardly when moving from the down position to the back-support position. The translation and the pivoting motions combine to produce a motion wherein the head section pivots relative to the seat section about an effective pivot axis positioned to lie above the lower deck.

The vertical distance between the sleeping surface and the reduced-shear pivot assembly can be minimized when the chair bed includes a step deck having upper deck side portions and a corresponding thin mattress portion. Mounting the reduced-shear pivot assembly to the walls connecting the lower deck and the upper deck portion minimizes the extent that the reduced-shear pivot assembly is required to raise the effective pivot axis above the reduced-shear pivot assembly as compared to a reduced-shear pivot assembly mounted to the bottom of a deck.

The step deck can also include an upper deck end portion adjacent to the foot end of the bed. The foot section can be coupled to the upper deck end portion for pivoting movement about a pivot axis that is positioned to lie above the lower deck. The foot section can also be configured to contract and expand to vary the length of the foot section as the foot section pivots about the pivot axis so that the foot section can pivot downwardly when the chair bed is in the low position to place the feet of the person supported on the sleeping surface on the floor. In addition, the foot portion of the mattress can be configured to shorten in conjunction with the contraction of the foot section. Also, the foot portion of the mattress can automatically become thinner to maintain an appropriately sized seat area as the foot section pivots downwardly.

It is an object of the present invention to provide a bed having unique head and foot section reduced-shear pivots. The bed has a head end, a foot end, and sides. The bed comprises a frame and an articulated deck supported by the frame. The deck has a head section, a seat section, and a foot section. A mattress having a support surface is supported on the deck. At least one of the deck sections is coupled to the deck for movement between a generally horizontal position and a tilted position about a first effective pivot axis above the support surface.

A conventional bed having a head portion that pivots upwardly may pivot about a pivot axis adjacent to the bottom surface of the deck carrying the mattress of the conventional bed. However, the hip of the person carried by the top surface will be several inches above the pivot axis of the conventional bed. As a result, shear forces between the person carried on the top surface and the top surface of the conventional bed when the head portion of the conventional bed pivots upwardly causing the top surface of the conventional bed to scrub against the person. This scrubbing action will often be detrimental to the skin of patients, particularly older patients with a potential for serious decribitis ulcers.

In contrast, the chair bed in accordance with the present invention is provided with a reduced-shear pivot, including shear-reducing means connected to the frame for mounting the head portion to the frame for both translational movement and pivoting movement relative to the frame. The pivoting and translational movements of the shear-reducing means combine to produce a motion of the head section in which the head section pivots relative to the frame about an effective pivot axis positioned to lie above the sleeping surface. Preferably, the effective pivot axis is generally coincident with the pivot axis of the hip of the person carried by the sleeping surface so that the shear forces between the person and the sleeping surface are minimized, thereby minimizing the scrubbing of the sleeping surface against the person.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE ILLUSTRATIVE AND PREFERRED EMBODIMENTS

Figure 1:
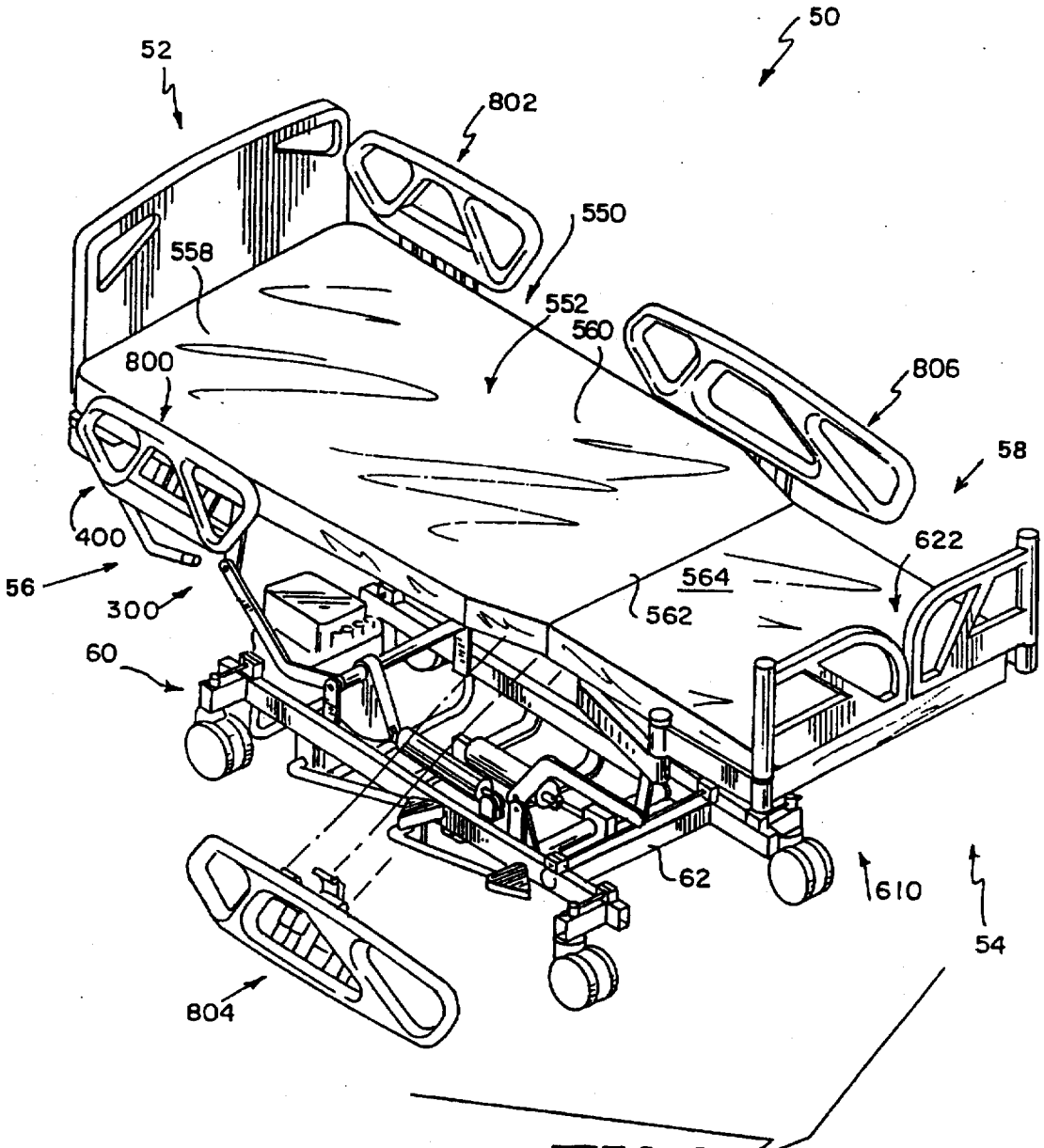
FIG. 1 is a perspective view of a chair bed in accordance with the present invention showing a side rail exploded away from the chair bed, head side rails and foot side rails positioned along longitudinal sides of the deck, and a swinging foot gate in a closed position.

A chair bed 50 in accordance with the present invention having a head end 52, a foot end 54, and sides 56, 58 is illustrated in FIG. 1. As used in this description, the phrase "head end 52" will be used to denote the end of any referred-to object that is positioned to lie nearest head end 52 of chair bed 50. Likewise, the phrase "foot end 54" will be used to denote the end of any referred-to object that is positioned to lie nearest foot end 54 of chair bed 50.

Figure 11:
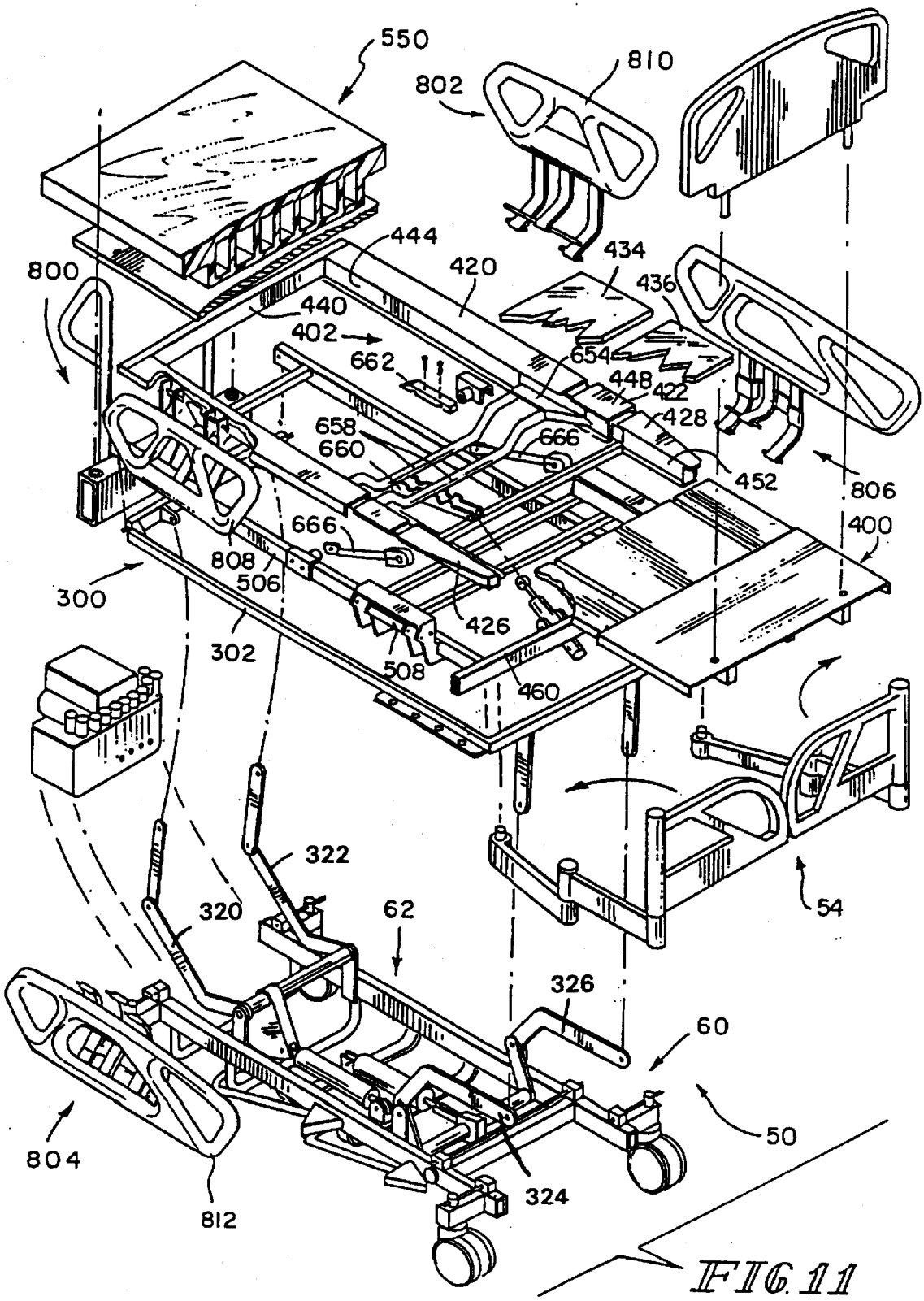
FIG. 11 is an exploded perspective view of the chair bed of, FIG. 1 with portions broken away.

Chair bed 50 includes a base module 60 having a base frame 62 connected to an intermediate frame module 300 by lift arms 320, 322, 324, 326 as shown in FIGS. 1 and 11. An articulating deck/weigh frame module 400 is coupled to intermediate frame module 300 by load beams. Side rail assemblies 800, 802, 804, 806 and an extended frame module 610 having a swinging foot gate 622 are coupled to articulating deck/weigh frame module 400. A mattress 550 is carried by articulating deck/weigh frame module 400 and provides a sleeping surface or support surface 552 configured to receive a person (not shown).

Chair bed 50 can be manipulated by a caregiver or by a person (not shown) on sleeping surface 552 using hydraulic system module 100 so that mattress 550, an intermediate frame 302 of intermediate frame module 300, and an articulating deck 402 of articulating deck/weigh frame module 400 assume a variety of positions, several of which are shown diagrammatically in FIGS. 3–7.

Articulating deck 402 includes a head section 404, a seat section 406, a thigh section 408, and a foot section 410. Mattress 550 rests on deck 402 and includes a head portion 558, a seat portion 560, a thigh portion 562, and a foot portion 564, each of which generally corresponds to the like-named portions of deck 402, and each of which is generally associated with the head, seat, thighs, and feet of the person on sleeping surface 552. Details of deck 402 and mattress 550 will be explained hereinafter.

Figure 3:
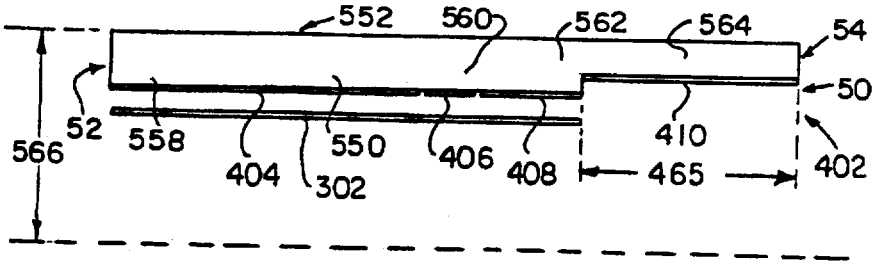
FIG. 3 is a diagrammatic view of the chair bed of FIG. 1 showing the chair bed in a bed position including a mattress having an upwardly-facing sleeping surface held a predetermined first distance above the floor, the deck being in an initial position supporting the sleeping surface in a generally planar configuration, and the foot section being a first length.
Figure 4:
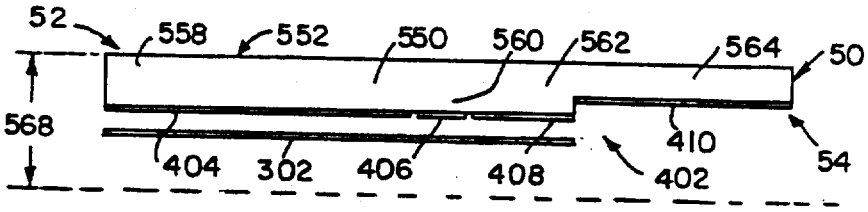
FIG. 4 is a diagrammatic view showing the chair bed in a low position.

Chair bed 50 can assume a bed position having deck 402 configured so that sleeping surface 552 is planar and horizontal, defining an initial position of deck 402 as shown in FIG. 1 and as shown diagrammatically in FIG. 3. In the bed position, sleeping surface 552 is a predetermined first distance 566 above the floor. Chair bed 50 can also be manipulated to assume a low position shown diagrammatically in FIG. 4 having deck 402 in the initial position and having sleeping surface 552 a predetermined second distance 568 above the floor, the second distance 568 being smaller than first distance 566. The foot section 410 of the articulating deck 402 has a first length 465 when the deck 402 is in the initial position.

Figure 5:
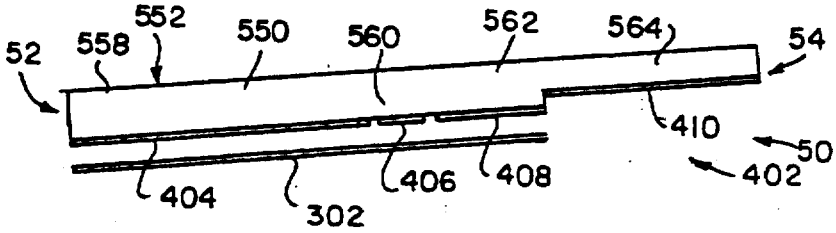
FIG. 5 is a diagrammatic view showing the chair bed in a Trendelenburg position.
Figure 6:
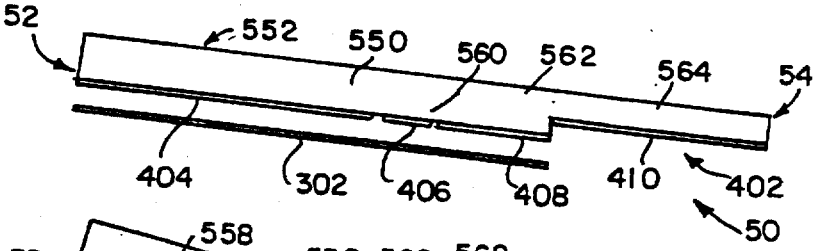
FIG. 6 is a diagrammatic view showing the chair bed in a reverse Trendelenburg position.
Figure 7:
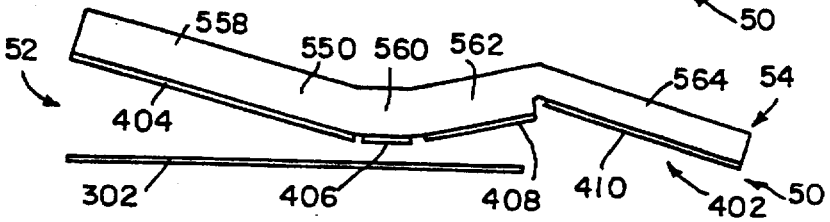
FIG. 7 is a diagrammatic view showing the chair bed in an intermediate position having a head end of a head section of the deck pivoted slightly upward from the initial position of the deck, a seat section positioned to lie in the horizontal plane defined by the seat section in the initial position of the deck, and the foot section being inclined slightly so that the foot end of the foot section lies below the position of the foot section when the deck is in the initial position of the deck.

Chair bed 50 can be moved to a Trendelenburg position shown diagrammatically in FIG. 5 having deck 402 in a planar configuration and tilted so that head end 52 of sleeping surface 552 is positioned to lie closer to the floor than foot end 54 of sleeping surface 552. Chair bed 50 can also achieve a reverse Trendelenburg position shown diagrammatically in FIG. 6 having deck 402 in a planar configuration and tilted so that foot end 54 of sleeping surface 552 is positioned to lie closer to the floor than head end 52 of sleeping surface 552.

Figure 2:
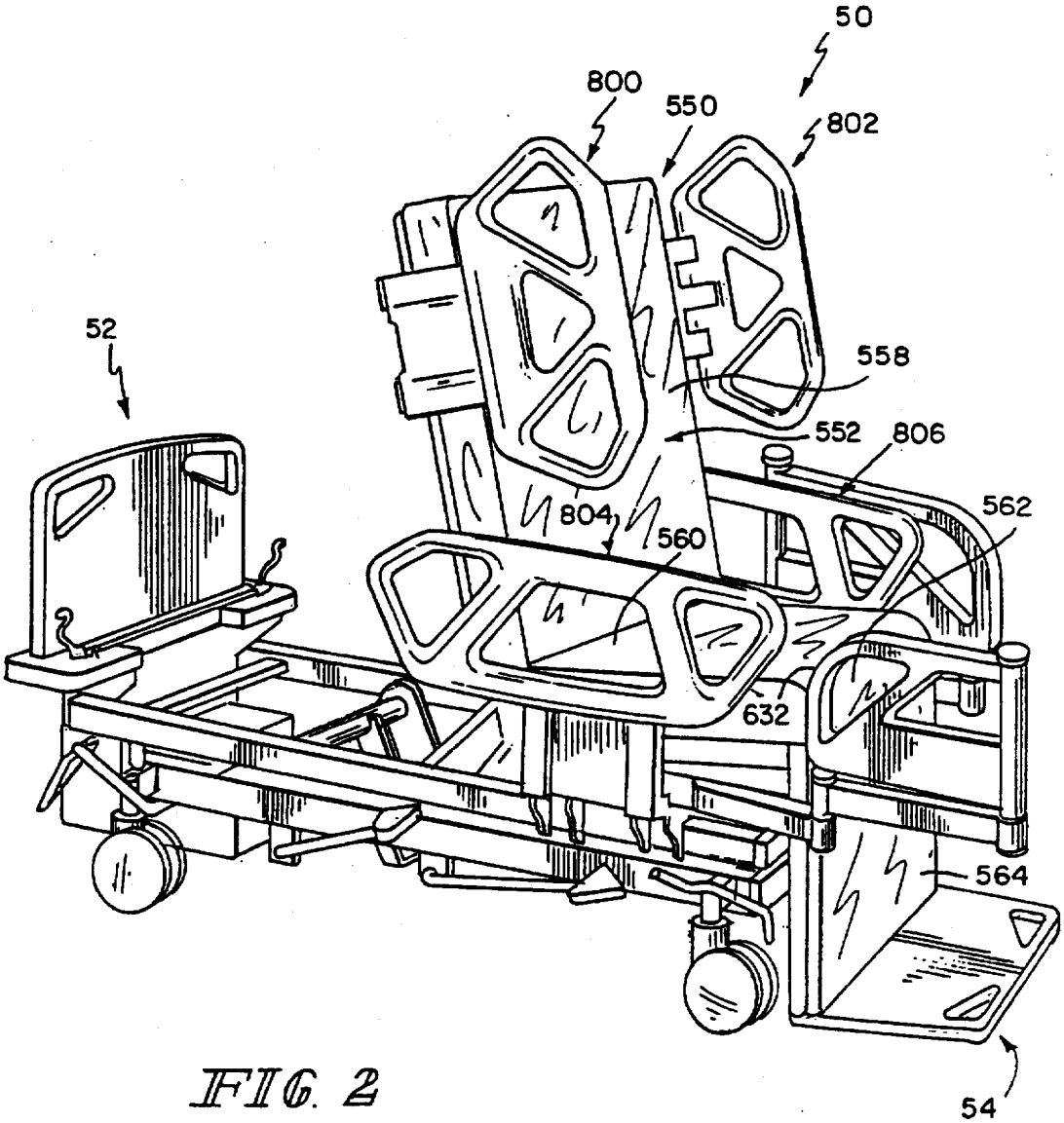
FIG. 2 is a view similar to FIG. 1 showing the chair bed in the sitting position having a head section of an articulating deck moved upwardly to a back-support position, a thigh section of the deck inclined slightly upwardly, a foot section of the deck moved to a generally vertical downwardly extending down position, a foot portion of the mattress being deflated, and swinging gates moved to an open position with one swinging gate folded next to the chair bed.
Figure 8:
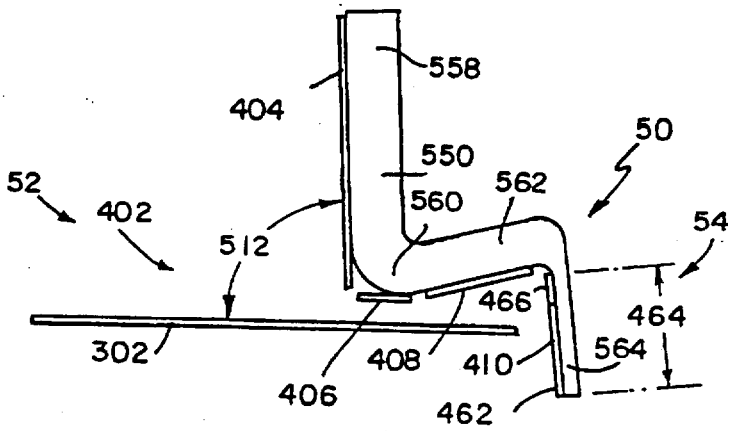
FIG. 8 is a diagrammatic view showing the chair bed in a sitting or chair position with the head end of the head section pivoted upwardly away from the seat section to a back-support position, the seat section lying generally horizontal as in the initial deck position, the thigh section being raised upwardly, the foot section extending downwardly from the thigh section and being a second shorter length, and the portion of the mattress over the foot section being deflated.
Figure 9:
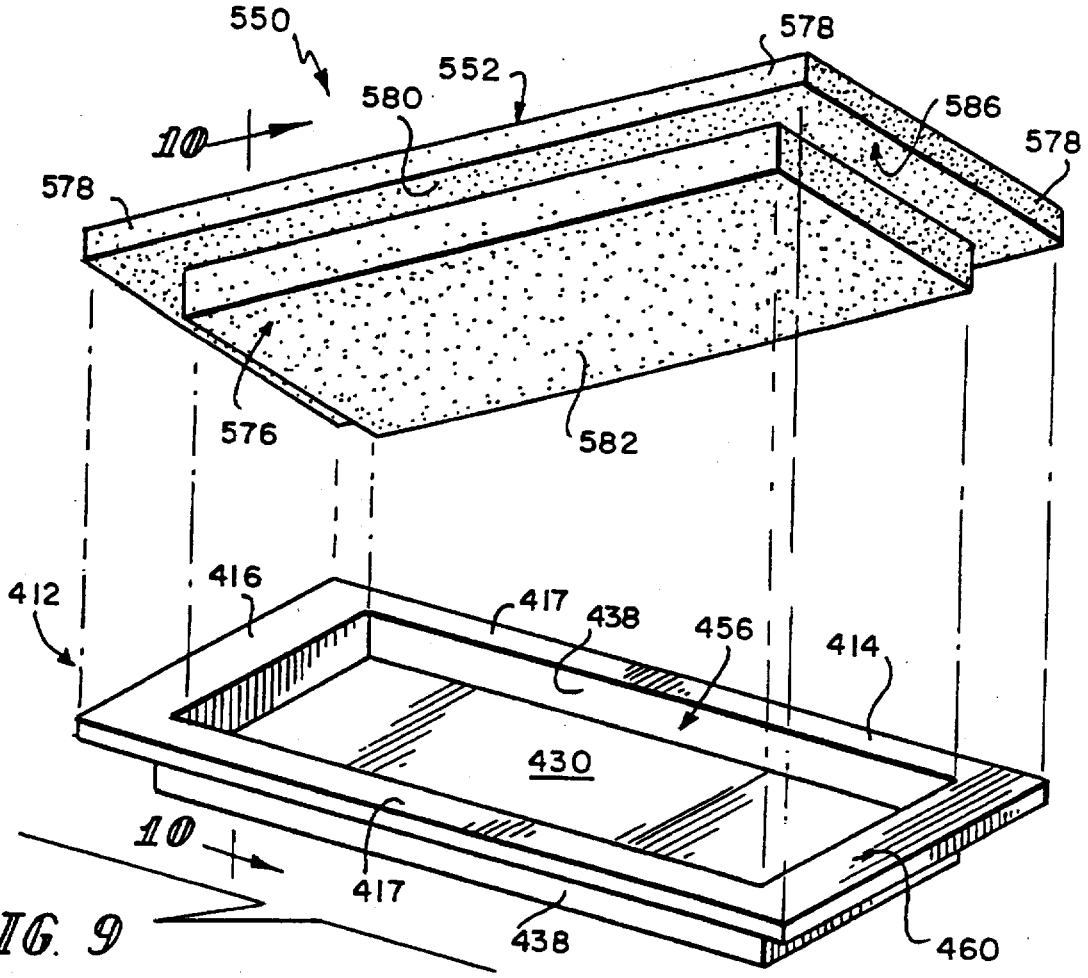
FIG. 9 is a perspective view of a first embodiment of a step deck and a mattress in accordance with the present invention.

As described above, chair bed 50 is convertible to a sitting position shown in FIG. 2 and shown diagrammatically in FIG. 8. In the sitting position, head end 52 of head section 404 of deck 402 is pivoted upwardly away from intermediate frame 302 to a back-support position providing a pivotable backrest so that head section 404 and intermediate frame 302 form an angle 512 generally between 55 and 90 degrees. Seat section 406 of deck 402 is positioned to lie generally horizontally as in the initial position, foot end 54 of thigh section 408 is slightly upwardly inclined, and foot section 410 of deck 402 extends generally vertically downwardly from thigh section 408 and has a length 464 that is shorter than when deck 402 is in the initial position. Foot portion 564 of mattress 550 is inflatable and is in a deflated condition when chair bed 50 is in the sitting position. Foot portion 564 of mattress 550 is thinner and shorter when deflated than when inflated.

Chair bed 50 is capable of assuming positions in which head, thigh, and foot sections 404, 408, 410 of deck 402 are in positions intermediate to those shown in FIGS. 3 and 8. For example, chair bed 50 can assume an intermediate position shown diagrammatically in FIG. 7 and also shown in FIG. 12, having head end 52 of head section 404 of deck 402 pivoted slightly upwardly from the initial position, seat section 406 positioned to lie in the same generally horizontal plane as in the initial position, foot end 54 of thigh section 408 raised slightly upwardly from the initial position, and foot section 410 being inclined so that foot end 54 of foot section 410 lies below head end 52 of foot section 410.

Figure 15:
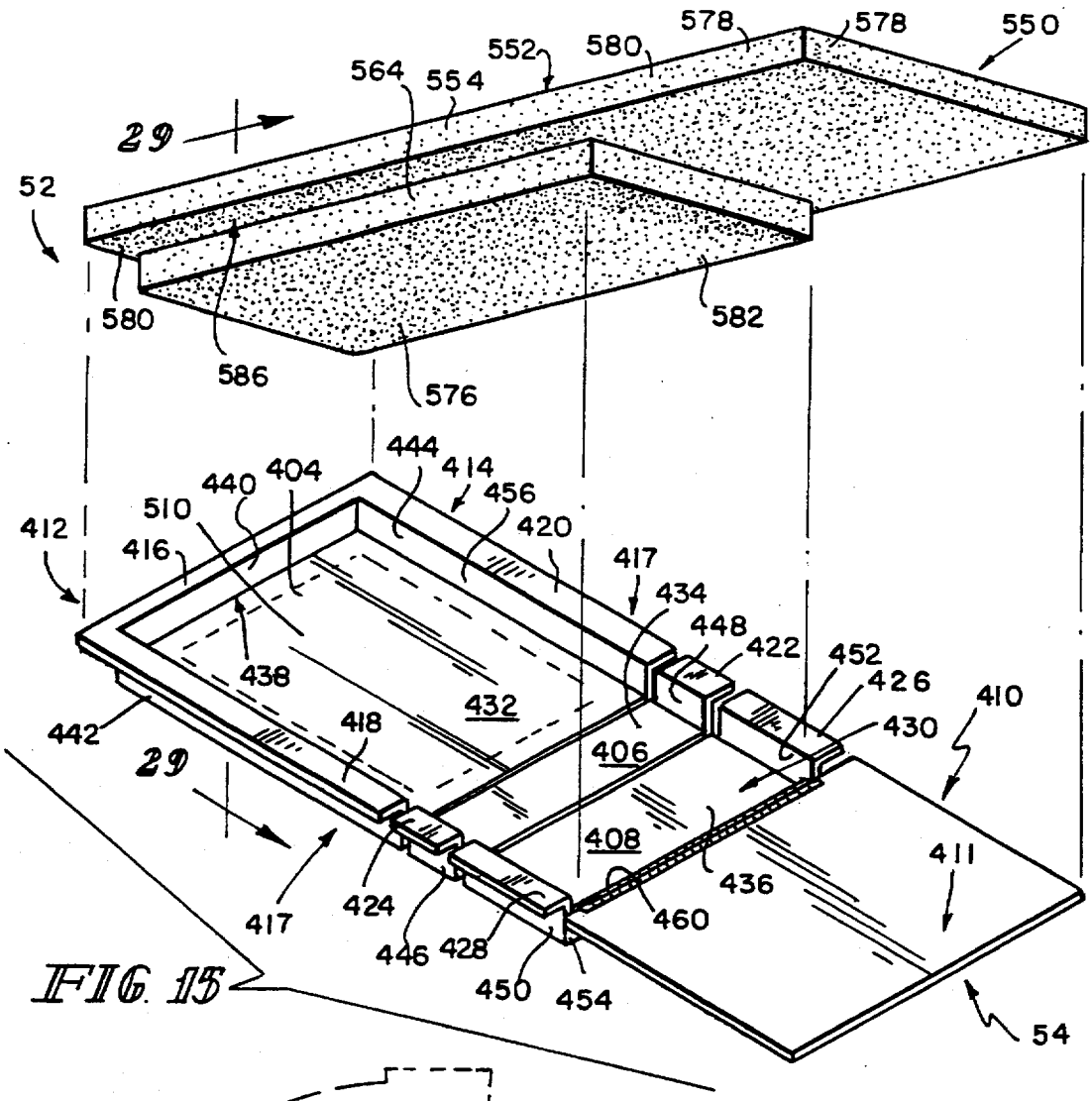
FIG. 15 is an exploded perspective view of a second embodiment of a step deck and the mattress of the chair bed.
Figure 16:
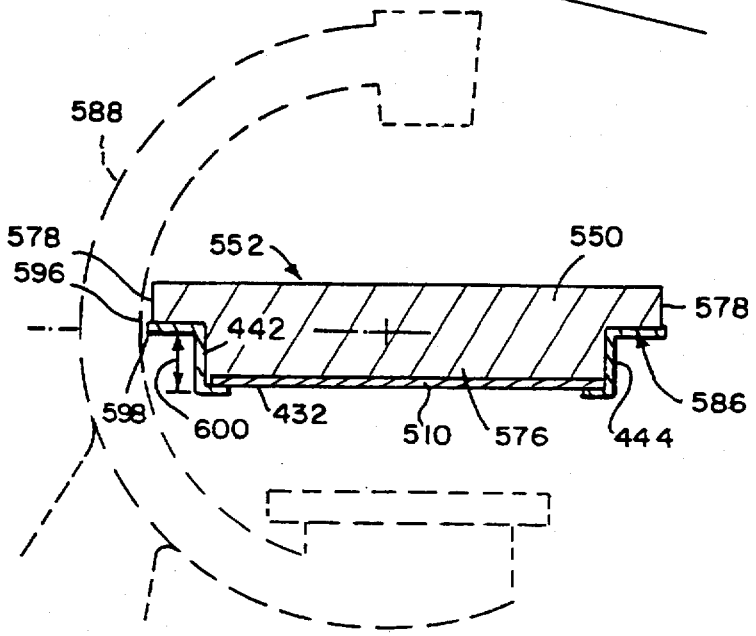
FIG. 16 is a sectional view taken through the step deck and the mattress of FIG. 15 and showing a C-arm 58 (in phantom) for holding medical equipment such as fluoroscopic equipment.
Figure 17:
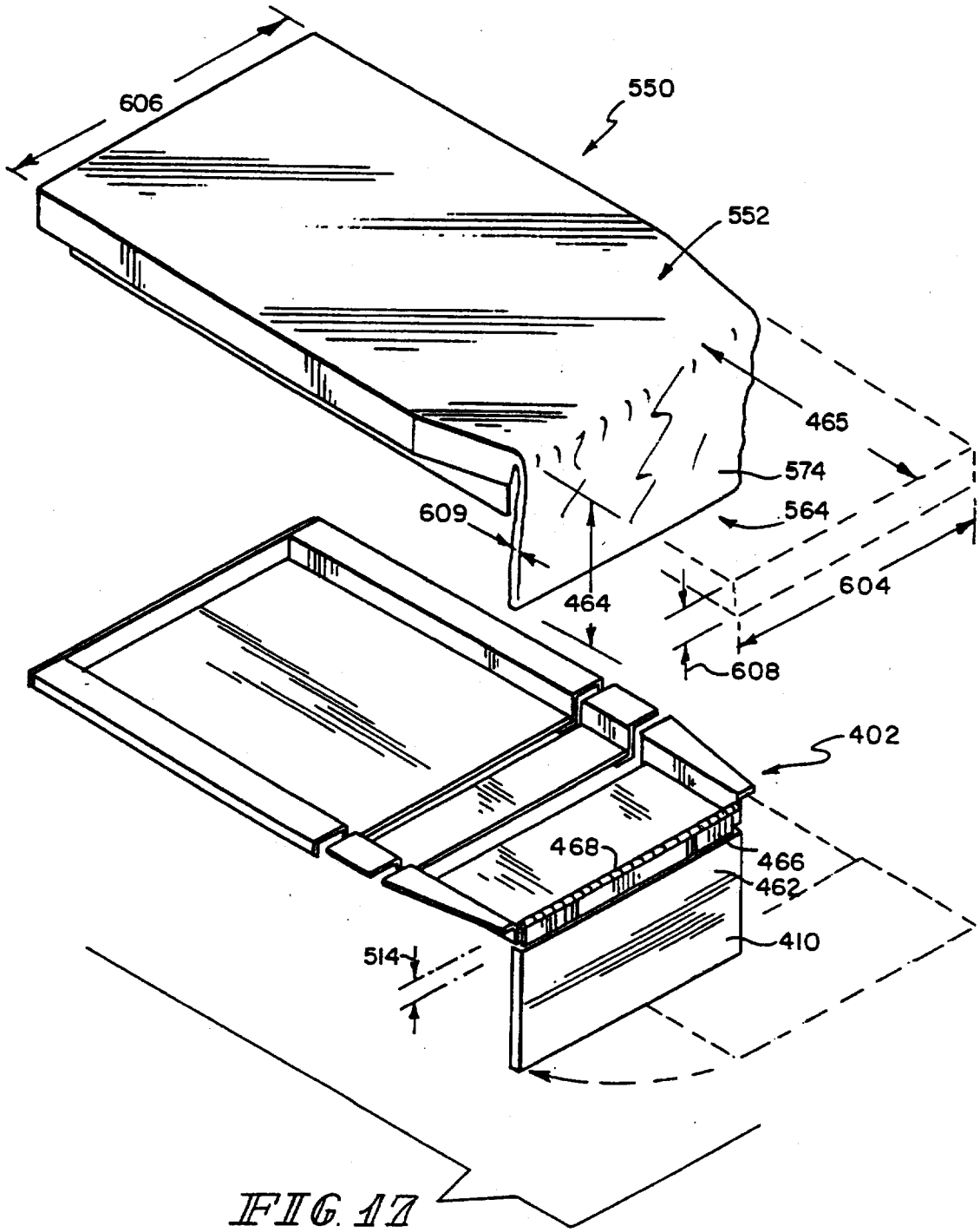
FIG. 17 is an exploded perspective view of a third embodiment of the mattress and the deck showing the foot section of the deck and the foot portion of the mattress in a minimized condition having the foot section of the deck contracted and the foot portion of the mattress contracted longitudinally and deflated so that the foot portion of the mattress is thinner and shorter than when foot portion is inflated.

Additionally, articulating deck 402 of chair bed 50 is configured as a step deck 412 as shown illustratively along with illustrative step mattress 550 in FIGS. 9, 10, and 15–17. The step deck and mattress of FIGS. 15–17 are those illustrated in FIGS. 3–8. Step deck 412 includes an upper deck 414 and a central, longitudinally extending recess 456 defined by a lower deck 430 of step deck 412 and a wall 438 surrounding recess 456 and connecting lower deck 430 to upper deck 414. Upper deck 414 includes longitudinally extending upper deck side portions 417, a head end upper deck end portion 416, and a foot end upper deck end portion 460.

Mattress 550 includes a generally upwardly-facing sleeping surface 552 and a bottom surface 586 that is generally parallel to sleeping surface 552 and that is positioned to lie beneath sleeping surface 552. A perimetral side 578 connects sleeping surface 552 and bottom surface 586. A projection 576 is appended to bottom surface 586 and extends downwardly therefrom. Preferably, projection 576 is spaced-apart from sides 578 of mattress 550 and nests in recess 456. Projection 576 may engage wall 438 of step deck 412 to prevent movement of mattress 550 relative to step deck 412 and to maintain the generally central position of mattress 550 on deck 412.

Figure 10:
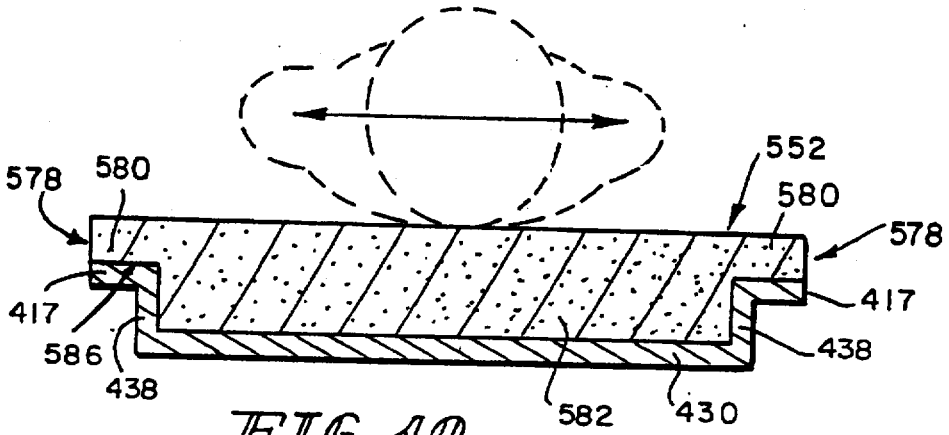
FIG. 10 is a sectional view taken along line 10—10 of FIG. 9 showing the bottom of the step deck beneath the projection.

Preferably, mattress 550 is provided with a thick zone 582 adjacent to recess 456 and projection 576, and a thin zone 580 engaging upper deck 414 as shown in FIG. 10. For example, thick zone 582 can be one and one-half times the thickness of thin zone 580. In one preferred, embodiment, the thick zone is approximately 7½ inches (19 cm) thick and the thin zone is 5 inches (12.7 cm) thick. Thick zone 582 is positioned to carry the majority of the weight of a person (shown in phantom) supported on sleeping surface 552 to maximize the comfort of the person. Having perimetral thin zone 580 provides a perimetral portion of mattress 550 that appears to the person on sleeping surface 552 to be firmer than thick zone 582, facilitating entry onto and exit from sleeping surface 552 along sides 578 of mattress 550.

As can be seen, step deck 412 and mattress 550 can be used in many applications requiring a support surface for supporting a person. For example, step deck 412 and mattress 550 can be configured for use as a stretcher to be carried by caregivers and as a gurney having step deck 412 mounted on a frame with wheels for transporting the person supported by the gurney.

Figure 13:
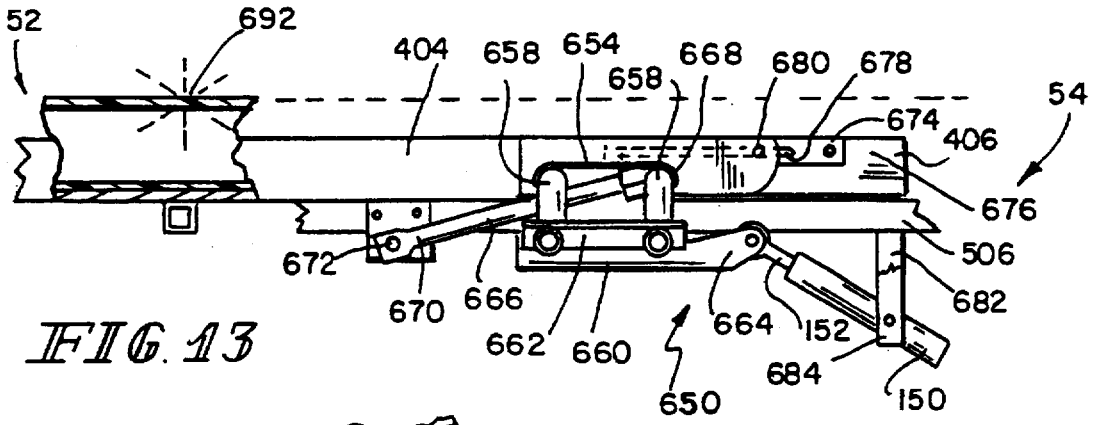
FIG. 13 is a view similar to FIG. 12 showing portions of the head section of the articulating deck and the reduced-shear pivot assembly in the down position shown in FIG. 3.
Figure 14:
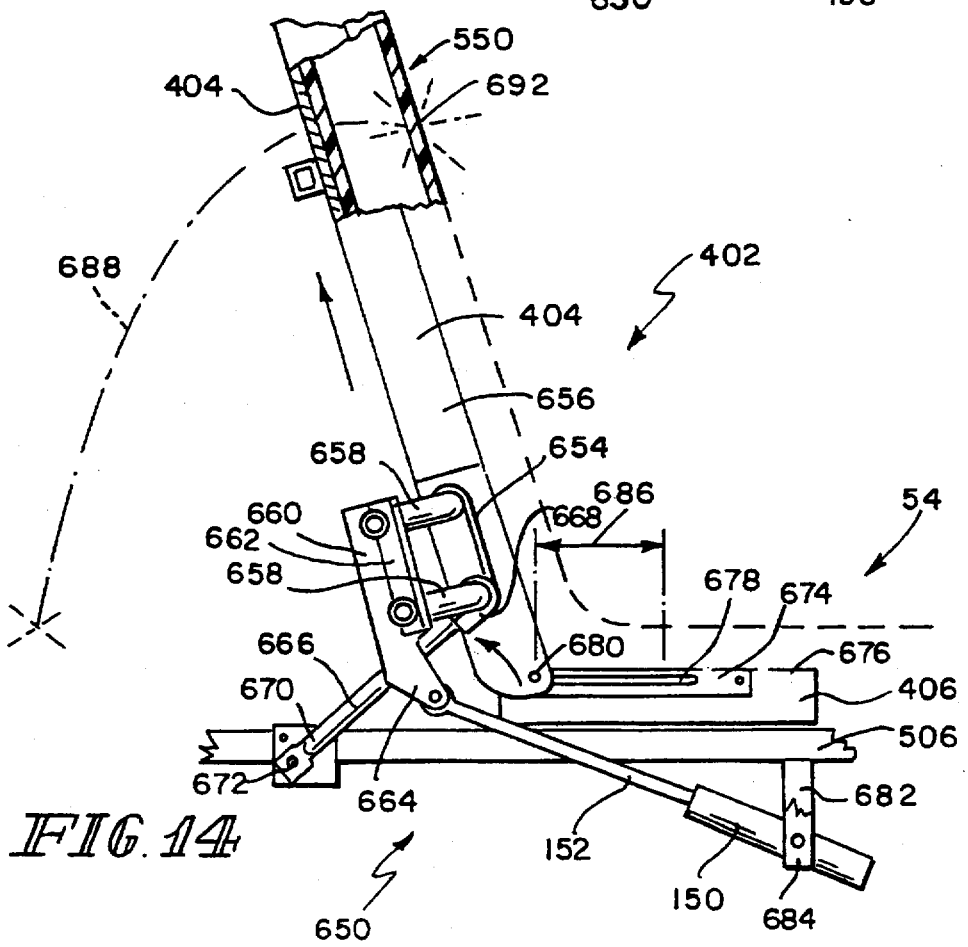
FIG. 14 is a view similar to FIG. 13 showing portions of the head section and the reduced-shear pivot assembly in the back-support position shown in FIG. 8.

Articulating deck 402 is the surface upon which the mattress 550 rests as shown in FIGS. 15–17. Deck 402 is illustratively segmented into head, seat, thigh, and foot sections 404, 406, 408, 410, three of which, head section 404, thigh section 408, and foot section 410, may be rotated to change the angle of inclination of the back, thighs, and lower legs of the person (not shown) with respect to seat section 408. Head section 404 has a special "reduced-shear pivot" which is the movement produced by a reduced-shear pivot assembly 650 to be described hereinafter that causes head section 404 to pivot about an effective pivot axis 642 that is positioned to lie above lower deck section 510 and that is preferably at upper deck 414 as shown in FIGS. 13 and 14. Seat section 406 of deck 402 remains horizontal and the head, thigh, and foot sections 404, 408, 410 of deck 402 can move relative to the seat section 406 and relative to each other, thereby moving the head, thigh, and foot portions 558, 562, 564 of mattress 550 relative to seat portion 560 of mattress 550 and relative to each other.

Head section 404 is coupled to weigh frame 506 by reduced-shear pivot assembly 650 shown in FIGS. 11–14. Reduced-shear pivot assembly 650 mounts head section 404 to weigh frame 506 for both translational movement and pivoting movement of head section 404 relative to seat section 406 of deck 402 and relative to weigh frame 506. The pivoting and translational movements combine to produce a motion in which head section 404 pivots relative to weigh frame 506 about an effective pivot axis positioned to lie above lower deck 430 and immediately adjacent upper deck 414. The shear between the back of the person and the sleeping surface 552 caused by movement of head section 404 is reduced, thereby reducing scrubbing of the sleeping surface 552 against the person.

Reduced-shear pivot assembly 650 includes brackets 654 mounted to each side 656 of head section 404 as shown in FIGS. 11–14. Brackets 654 connect flattened U-shaped struts 658 that-span head section 404 to sides 656 as shown in FIG. 11. A lever arm 660 having a cap 662 is fixed to struts 658 and extends longitudinally in a direction parallel to the sides 656 of head section 404 toward foot end 54 of chair bed 50, terminating in a tip 664 as shown best in FIGS. 12–14. Two spacer rods 666 each have a first end 668 pivotably coupled to struts 658 adjacent to brackets 654 and a second end 670 pivotably connected to weigh frame 506 so that spacer rods 666 pivot about a spacer pivot axis 672. Spacer rods 666 maintain the separation between spacer pivot axis 672 and struts 658 as head section 404 moves between the back-support position of FIG. 12 and the down position of FIG. 13.

Figure 12:
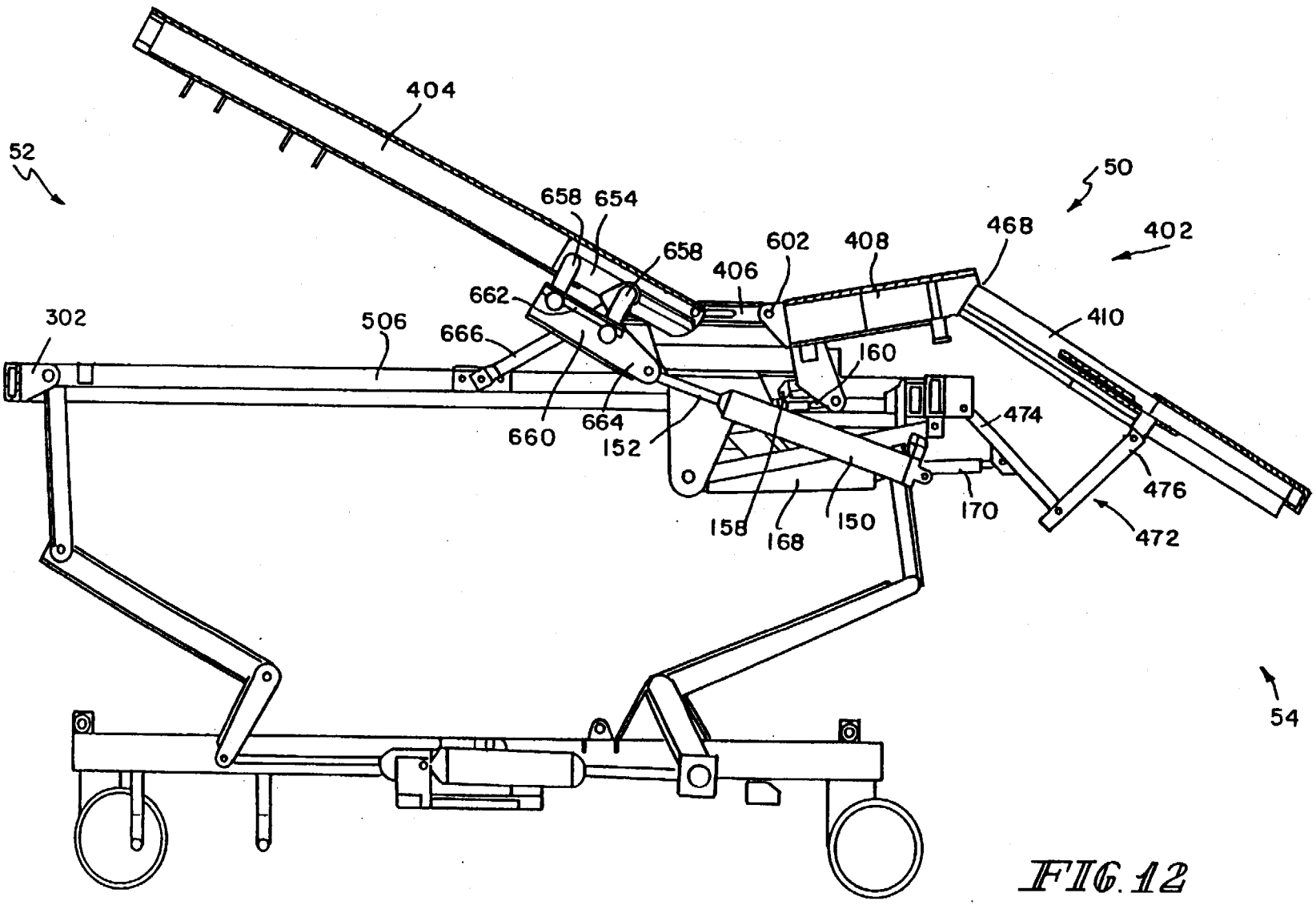
FIG. 12 is a sectional view taken through the chair bed of FIG. 1 having the chair bed in the intermediate position similar to the position shown in FIG. 7.

Slotted brackets 674 are fixed to sides 676 of seat section 406 adjacent to foot end 54 of head section 404 as shown in FIGS. 12–14. Each slotted bracket 674 is formed to include a horizontal longitudinal slot 678. Foot end 54 of head section 404 includes pins 680 that are received by slots 678. Pins 680 and slots 678 cooperate to guide the movement of foot end 54 of head section 404 so that foot end 54 of head section 404 translates horizontally or longitudinally toward head end 52 of chair bed 50 when head section 404 pivots upwardly to the back-support position.

Head section pivot cylinder 150 operates to pivot head section 404 between the down position and the back-support position as shown in FIGS. 11–14. A bracket 682 having a distal end 684 is fixed to an upper deck end portion 460 of thigh section 408. Bracket 682 is generally centrally located along weigh frame end portion 460. Head section pivot cylinder 150 is pivotably coupled to distal end 684 of bracket 682 and piston rod 152 of head section pivot cylinder 150 is pivotably coupled to tip 664 of lever arm 660 so that head section pivot cylinder 138 and lever arm 660 act between struts 658 of head section 404 and weigh frame 506.

When head section 404 is in the down position shown, for example, in FIG. 13, head end pivot cylinder 150 is in a deactivated configuration having piston rod 152 in the retracted position. Head section 404 and lever arm 660 are generally parallel to weigh frame 506 when head section 404 is in the down position.

When head end pivot cylinder 150 moves to the extended position, piston rod 152 pushes tip 664 of lever arm 660 toward head end 52 of chair bed 50. Lever arm 660 pushes against struts 658 to pivot head section 404 upwardly to the back-support position as shown in FIG. 14. Pins 680 cooperate with slots 678 so that foot end 54 of head section 404 moves longitudinally toward head end 52 of chair bed 50 a distance 686. At the same time, spacer rods 666 swing upwardly forcing head section 404 to engage in the motion illustratively shown by arc 688 in FIG. 14 combining the pivoting movement of head section 404 and the translating movement of head section 404 to provide the reduced-shear pivot. Since pivot pins 680 are located immediately adjacent the top of side walls 438 of step deck 412, the pivot is between sleeping surface 552 and bottom 586 of mattress 550. This reduces the travel required to reduce shear between the person (not shown) and sleeping surface 552.

The longitudinal displacement of the pivot is selected to prevent a crease in mattress 550 between head and seat portions 558, 560. The effective point of contact on mattress back portion 558 extends as it pivots upwardly as does the corresponding point on the person on sleeping surface 552 as the person pivots about his or her hip. As a result of the reduced-shear pivot assembly 650, the point of contact on mattress back portion 558 and the corresponding point on the person move together, thus reducing the sliding of the person relative to sleeping surface 552.

Although the surface of the person's back expands when the person pivots upwardly to a sitting position, the surface of the back legs of the person contract as the back legs pivot downwardly. As will be explained with respect to FIGS. 15 and 17, foot section 410 of deck 402 and foot portion 564 of mattress 550 are mounted and constructed to shorten in length and mattress 550 thins and shortens in length when pivoting to the sitting position to effect a reduced-shear pivot.

As can be seen, head section 404 translates relative to seat section 406 when head section 404 pivots from the down position to the back-support position. This relative translation effectively expands the length of deck 402 at the junction of the back and seat during the articulation of deck 402. When the upwardly-facing person (not shown) supported by surface 552 moves from a lying position to a sitting position, the back (not shown) of the person lengthen. The effective expansion of deck 402 at the juncture of seat section 406 and head section 404 and the consequent expansion of surface 552 conforms to the lengthening of the back of the person to reduce the shear that could take place between the person and surface 552. For the foot-seat juncture, surface 552 contracts when moving from a lying position to a sitting position.

In other words, the expansion of deck 402 and surface 552 at the back and contraction at the foot allows the lower body of the person to remain stationary relative to surface 552 when tilting the upper body of the person, which also remains stationary relative to surface 552, in order to minimize the scrubbing between the person and surface 552 during articulation of deck 402. The reduced-shear pivot also minimizes the migration of the person on sleeping surface 552 toward foot end 54 of chair bed 50 as head section 404 is repeatedly raised and lowered and minimizes "bunching" of mattress 550 and the potential corresponding pressure on the hip and shoulder of the person.

Foot section 410 of articulating deck 402 is movable from a generally horizontal up position parallel to intermediate frame 302 as shown in FIGS. 1 and 3 to a generally vertically downwardly extending down position to permit the lower legs and feet of the person (not shown) to be lowered to the sitting position as shown in FIGS. 2 and 8. Foot section 410 can also be contracted from an expanded position having a longitudinal length 465 as shown in FIGS. 3 and 17 to a contracted position having foot end 54 of foot section 410 drawn inwardly toward head end 52 of chair bed 50 so that foot section 410 has a longitudinal length 464 that will "clear" the floor when foot section 410 moves to the down position as shown in FIGS. 8 and 17. Preferably, length 464 of foot section 410 when foot section 410 is contracted is such that foot end 54 of foot section 410 clears the floor and is spaced-apart therefrom sufficiently to permit a base (not shown) of an over bed table (not shown) to fit therebetween.

The head, seat, thigh, and foot sections 404, 406, 408, 410 of articulating deck 402 cooperate to define a step deck 412 as shown best in FIGS. 11, and 15–17. Step deck 412 includes an upper deck 414 having a head end upper deck portion 416 appended to head end 52 of head section 404, side upper deck portions 418, 420, 422, 424, 426, 428 appended to sides of the head, seat, and thigh sections 404, 406, 408, and a foot end upper deck portion 460 appended to foot end 54 of weigh frame 506 adjacent to thigh section 408. The upper deck portions 416, 418, 420, 422, 424, 426, 428, 460 and a top surface 411 of foot section 410 are coplanar when articulating deck 402 is in the initial position and cooperate to form upper deck 414 which is generally parallel to weigh frame 506.

Step deck 412 also includes a lower deck 430 having a head slat 432, a seat slat 434, and a thigh slat 436. Head, seat, and thigh slats 432, 434, 436, are coplanar when articulating deck 402 is in the initial position and they cooperate to form lower deck 430 which is generally parallel to weigh frame 506 and to upper deck 414 when articulating deck 402 is in the initial position.

Lower deck 430 is connected to upper deck 414 by a wall 438 including a head end wall 440 connecting head slat 432 to head end upper deck portion 416, side walls 442, 444, 446, 448, 450, 452 connecting head, seat, and thigh slats 432, 434, 436 to side upper deck portions 418, 420, 422, 424, 426, 428, and a foot end wall 454 connecting thigh slat 436 to foot end upper deck portion 460 as shown in FIGS. 11 and 15. Step deck 412, then, comprises upper deck 414 and is formed to include a central, longitudinally extending recess 456 defined by lower deck 430 and by wall 438 connecting lower deck 430 to upper deck 414. In the preferred embodiment, foot section 410 of step deck 412 is displaced from recess 456 and forms part of upper deck 414, as shown in FIGS. 15 and 17.

In preferred embodiments, head section 404 of articulating deck 402 is coupled to weigh frame 506 by reduced-shear pivot assembly 650 immediately adjacent upper deck 414 which causes head section 404 of articulating deck 402 to pivot relative to weigh frame 506 between the down position and the back-support position. Combining step deck 412 and reduced-shear pivot assembly 650 in chair bed 50 allows reduced-shear pivot assembly 650 to be mounted to wall 438 rather than to a bottom of a conventional deck. Consequently, the vertical distance between sleeping surface 552 and reduced-shear pivot assembly 650 is minimized. This minimizing the extent that reduced-shear pivot assembly 650 is required to raise effective pivot axis above reduced-shear pivot assembly 650.

Mattress 550 is received by articulating deck 402 and includes a projection 576 sized to be received by recess 456 as shown in FIGS. 15 and 16. Consequently, mattress 550 is thinner along sides 580 of mattress 550 where mattress 550 engages upper deck 414 of step deck 412. Conversely, mattress 550 is thicker in portions adjacent to projection 576. Preferably, projection 576 is positioned directly beneath portions of mattress 550 carrying a majority of the weight of the person on sleeping surface 552. The thick portion of mattress 550 including the thickness of mattress 550 between sleeping surface 552 and a bottom surface 586 engaging upper deck 414 plus the thickness of projection 576 provides greater comfort for the person on sleeping surface 552. Mattress 550, then, has a thinner perimetral zone 580 and a thicker body-support zone 582 adjacent to projection 576. Preferably, body support zone is 1½ times the thickness of perimetral zone 580. For example, perimetral zone can be 5 inches (12.7 cm) thick and body-support zone 582 can be 7½ inches (19 cm) thick.

Thinner perimetral zone 580 and upper deck side portions 417 cooperate to define "rammed" edges that provide greater firmness around the edges of sleeping surface 552 as the result of sleeping surface 552 being in close proximity to upper deck 414. This increased firmness is advantageous when the person enters and exits the bed along the sides of the bed.

Additionally, the rammed edges provide a firm edge that cooperates with side rail assemblies 800, 802, 804, 806 to minimize the potential for side rail entrapment, in which an object becomes wedged between sleeping surface 552 and one of side rails 808, 810, 812, 814. Also, step deck 412 cooperates with side rail assemblies 800, 802, 804, 806 to maximize the height relative to sleeping surface 552 at which side rails 808, 810, 812, 814 are mounted as shown in FIGS. 1 and 11. Tops of side rails 808, 810, 812, 814 can be higher when in the patient-restraining position for improved coverage and protection of the person (not shown) on sleeping surface 552 and bottoms 814 can be higher when in the tucked position for improved access to base frame 62 and to the space beneath intermediate frame 302.

Projection 576 includes a side wall 584 that can be configured to engage at least portions of the wall 438 of step deck 412 as shown in FIG. 16, thereby preventing lateral and longitudinal sliding of mattress 550 relative to step deck 412. Also, mattress 550 includes sides 578 connecting sleeping surface 552 and bottom surface 586. Mattress 550 and step deck 412 are configured so that sides 578 of mattress 550 are exposed above deck 402 as shown in FIGS. 10 and 16 providing the caregiver greater and easier access to mattress 550, rather than engaging a portion of a frame or upstanding walls of a deck as is found with conventional mattress and deck systems.

In preferred embodiments, sleeping surface 550 is generally planar and projection 576 is centrally located beneath sleeping surface 550 to form thick body support zone 582 of mattress 550 surrounded by perimetral zone 580 engaging upper deck 414. Mattress 550 may be provided in more than one piece, for example, mattress 550 may comprise a first mattress piece fit into recess 456 and a second mattress piece surrounding and abutting sides of the first mattress piece and engaging upper deck 414, or a first mattress piece could fit into recess 456 and a second mattress piece having a planar bottom surface could fit over the first mattress piece so that the bottom of the second mattress piece engages the first mattress piece and upper deck 414. However, a one-piece mattress 550 including both body-support zone 582 and perimetral zone 580 is preferred.

Additionally, mattress 550 can include an inflatable portion 574 that can assume both an inflated position and a deflated position. Preferably, inflatable portion 574 is positioned to lie in foot portion 564 as shown in FIG. 17 so that inflatable portion 574 can be inflated to serve as sleeping surface 552 when foot section 410 of deck 402 is in the up position and so that inflatable portion 574 can be deflated and inclined downwardly when the foot section 410 is lowered to the down position to provide room for the lower legs of the person when chair bed 50 is in the sitting position. Foot portion 564 is thinner and shorter when deflated than when foot portion 564 is inflated.

Foot portion 564 of mattress 550 and foot section 410 of articulating deck 402 cooperate to minimize the length of the foot of chair bed 50 as shown in FIG. 17. Foot section 410 and foot portion 564 are a first length 465 when foot section 410 is in the up position and a second length 464 when foot section 410 is in the down position, first length 465 being greater than second length 464. Also, foot portion 564 is a first thickness 608 when foot section 410 is in the up position and a second thickness 609 when foot section 410 is in the down position, first thickness 608 being greater than second thickness 609.

In addition, the width 604 of foot portion 564 of mattress 550 is less than the width 606 of head portion 558 of mattress 550, the width 606 of head portion 558 typically being a standard mattress width as shown in FIGS. 15 and 17. This difference between the widths 604, 606 permits a standard fitted sheet (not shown) to be tightly installed onto mattress 550 while remaining loose adjacent to foot portion 564 so that pressure relief can be maintained in the section of foot portion 564 receiving the heels (not shown) of the person (not shown) supported on sleeping surface 552. The smaller width 604 of foot portion 564, the contraction of foot section 410 and the corresponding contraction of foot portion 564, and the deflation of inflatable portion 574 when inflatable portion 574 is positioned to lie in foot portion 564, all act to minimize the foot of chair bed 50 when the foot section 410 moves from the up position to the down position so that the feet of the person supported on the sleeping surface 552 can reach the floor (not shown) or foot prop 646. The narrow foot section 410 of deck 402 and foot portion 564 of mattress 550 minimizes the width of foot end 54 of deck 402 so that the width of bed 50 adjacent to extended frame 610 is no greater than the width of bed 50 adjacent to body section side rails 812, 814.

Although the invention has been described in detail with reference to preferred embodiments, variations and modifications exist within the scope and spirit of the invention as described and defined in the following claims.

We claim:

1. A bed having a head end, a foot end, and sides, the bed comprising:

a frame and a deck carried by the frame, the deck including an upper deck portion and a central, longitudinal recess in the upper deck portion, the recess being defined by a lower deck portion and walls connecting the lower and the upper deck portions, a mattress including a planar, upwardly-facing patient surface, side portions resting on the side deck portions, and a central projection extending downwardly into the recess; and a first longitudinal deck section being coupled to the deck to pivot about a pivot axis above the lower deck portion between a generally horizontal position and a tilted position.

2. The bed of claim 1, wherein the first deck section is a head deck section longitudinally adjacent a seat deck section, and said head section moves rectilinearly and pivotally for movement between a back-support position and a down position.

3. The bed of claim 1, wherein the head deck section includes a pivot pin defining a first pivot axis and the first deck section pivots about the first pivot axis.

4. The bed of claim 3, wherein the pivot pin is longitudinally slidable relative to the frame to translate longitudinally when the head deck section moves between its positions.

5. The bed of claim 4, further comprising a strut having a first end pivotally coupled to the frame at a first coupling point beneath the first deck section and spaced apart from the seat section and a second end pivotally coupled to the head section at a second coupling point that is spaced apart from the first pivot axis, the strut keeping the distance between the first coupling point and the second coupling point constant when the head section moves between the down position and the back-support position.

6. The bed of claim 1, wherein the head section includes a foot end toward the foot of the bed and the wall adjacent to the seat section includes a longitudinal channel adjacent to the foot end of the head section.

7. The bed of claim 6, wherein the head section includes a bar rotatably coupled to the head section and slidable received by the channel.

8. The bed of claim 7, wherein the bar translates in the channel toward the head of the bed when the head section moves from the down position to the back-support position.

9. The bed of claim 1, wherein the first deck section is a footdeck section longitudinally adjacent a seat deck section.

10. The bed of claim 9, wherein the foot section is movable between a generally horizontal up position and a generally vertical downwardly extending down position, the foot section being a first length when the foot section is in the up position, a second length when the foot section is in the down position, the second length being less than the first length.

11. The bed of claim 9, wherein the foot section is movable between a generally horizontal up position and a generally vertical downwardly extending down position, and the mattress including a foot portion being inflated when the deck foot section is in the up position and being deflated when the deck foot section is in the down position.

12. The bed of claim 1, wherein the deck further includes a head end, a foot end, an upper deck end portion connected to the head end, an upper deck end portion connected to the foot end, and end walls connecting the bottom of the deck to the upper deck end portions.

13. The bed of claim 12, wherein the upper deck end portions cooperate with the upper deck side portions to form a continuous upper deck surrounding the recess.

14. The bed of claim 12, wherein the mattress further includes an inner zone including the portion of the mattress adjacent the projection and an outer zone including the portion of the mattress resting on the upper side deck portions.

15. The bed of claim 14, wherein the mattress further includes an inner mattress positioned to lie in the inner zone and an outer mattress positioned to lie in the outer zone, the outer mattress abutting the inner mattress.

16. The bed of claim 14, wherein the mattress further includes a portion that is inflatable and deflatable.

17. The bed of claim 16, wherein the inflatable and deflatable portion of the mattress is positioned to lie adjacent to the foot section of the deck.

* * * * *